United States Patent [19]

Meister

[11] 4,342,978

[45] Aug. 3, 1982

[54] EXPLOSIVELY-ACTUATED SWITCH AND CURRENT LIMITING, HIGH VOLTAGE FUSE USING SAME

[75] Inventor: Otto Meister, Arlington Heights, Ill.

[73] Assignee: S&C Electric Company, Chicago, Ill.

[21] Appl. No.: 21,646

[22] Filed: Mar. 19, 1979

[51] Int. Cl.[3] ..... H01H 85/18; H01H 33/06; H01H 33/28

[52] U.S. Cl. ..... 337/6; 200/82 B; 200/151; 337/158; 337/221; 337/276; 337/401

[58] Field of Search ..... 337/31, 33, 35, 143, 337/144, 158–162, 221, 401, 402, 409, 2, 4, 6, 30, 276, 273; 60/634; 200/144 C, 151, 82 R, 82 B

[56] References Cited

U.S. PATENT DOCUMENTS

| | | | |
|---|---|---|---|
| 466,761 | 1/1892 | Wotton . | |
| 1,856,701 | 5/1932 | Gerdien . | |
| 1,917,315 | 7/1933 | Murray . | |
| 2,175,250 | 10/1939 | Burrows et al. . | |
| 2,305,436 | 12/1942 | McMorris . | |
| 2,306,153 | 12/1942 | Biermanns et al. . | |
| 2,337,495 | 12/1943 | Rawlins | 337/161 |
| 2,491,956 | 12/1949 | Curry . | |
| 2,548,112 | 4/1951 | Kaminky . | |
| 2,551,858 | 5/1951 | Stoelting et al. . | |
| 2,721,240 | 10/1955 | Filbert . | |
| 2,892,062 | 6/1959 | Bruckner et al. . | |
| 3,118,986 | 1/1964 | Lewis et al. | 200/82 R |
| 3,129,307 | 4/1964 | Vargas | 200/151 |
| 3,184,726 | 5/1965 | Hellgren . | |
| 3,400,301 | 9/1968 | Misare . | |
| 3,628,092 | 12/1971 | Keto | 337/186 |
| 3,748,418 | 7/1973 | Kawasaki | 200/82 B |
| 3,851,219 | 11/1974 | Kozorezov et al. | 337/401 |
| 3,958,206 | 5/1976 | Klint | 337/406 |
| 3,984,651 | 10/1976 | Lewis et al. | 200/144 C |

FOREIGN PATENT DOCUMENTS

| | | | |
|---|---|---|---|
| 1904244 | 8/1970 | Fed. Rep. of Germany | 337/401 |
| 2262393 | 9/1975 | France . | |
| 46-24655 | 7/1971 | Japan | 337/158 |

OTHER PUBLICATIONS

Blythe, "Limiting Fault Currents between Private and Public Networks," Electrical Review, Great Britian, Oct. 5, 1973.

"Fault Levels Too High?," Calor-Emag Corp. leaflet, No. 1197/6E.

Böttger," The Application of $I_s$–Limiters in Three Phase Systems," Calor–Emag Pub., circa Aug. 1967.

Perry et al., "Ultra–High Speed Ground Switch Application and Development," AIEE Paper No. 62–1109, Jun. 1962.

Heilmann, "The Economic Benefits of Using $I_s$–Limiters," Calor–Emag Co. Pub., circa Feb. 1963.

Keders et al., "A Current–Limiting Device for Service Voltages up to 34.5 kV," Paper A76 436–6, IEEE PES Summer Meeting, Portland, Oregon, Jul. 18–23, 1976.

(S2729–0150) Miyoshi et al., "Ultra–High Speed Protection Device, Fuji Ultrup Fuse," Fuji Electric Review, vol. 18, No. 1 pp. 49–51 (1972).

*Primary Examiner*—William H. Beha, Jr.

*Attorney, Agent, or Firm*—John D. Kaufmann

[57] ABSTRACT

A high speed high voltage electrical switch opens a current path in which the switch is included. The switch includes first and second normally electrically interconnected contacts which normally carry current in the current path. The contacts are relatively movable along a fixed line of direction. When the contacts move apart, the electrical interconnection therebetween is broken to open the first current path. A piston carried by the second contact defines an enclosed chamber in conjunction with the first contact when the contacts are interconnected. A power cartridge or the like selectively pressurizes the chamber to rapidly drive the contacts apart. The piston enhances the action of the power cartridge by ensuring that pressure increases caused thereby are effected to drive the contacts apart. The piston may be configured to ensure positive sealing engagement with the walls of a cylinder through which the piston and the second contact move following the ignition of the power cartridge. Moreover, the piston may be made of an ablative arc-extinguishing material so that following movement apart of the contacts, any arc formed between the contacts is constricted by the piston which evolves arc-extinguishing gas to ultimately extinguish the arc.

62 Claims, 12 Drawing Figures

14
20
22
46
56
58
60
62
64
66
68
72
74
76
77
78
80
82
84
86
88
90
92
94
96
98
100

EXPLOSIVELY-ACTUATED SWITCH AND CURRENT LIMITING, HIGH VOLTAGE FUSE USING SAME

BACKGROUND OF THE INVENTION

1. Field of the Invention

The present invention relates to an improved switch. The present invention also relates to an improved high-voltage device utilizing the improved switch and having a high continuous current rating. More specifically, the present invention relates to an improved high-voltage circuit-protection device, and to current-limiting or non-current-limiting high-voltage fuses, which, along with the improved switch, constitute a portion of the improved device, both types of fuses more conveniently achieving a higher continuous current rating than possessed by known fuses. The improved device is reliable in operation, convenient and economical to manufacture, and partially reusable, thereby reducing replacement and maintenance costs. The present invention is an improvement of the invention disclosed in commonly assigned abandoned U.S. patent application, Ser. No. 972,650, filed Dec. 21, 1978 in the name of Otto Meister.

2. Brief Discussion of the Prior Art

Fault currents (used herein to mean all undesirable over-currents), impress rather high thermal and mechanical stresses on high-voltage electric systems and on apparatus used in such systems. The severity of the thermal stresses is known to be generally proportional to the product of (1) the square of the fault current, and (2) time—i.e., $I^2t$. The severity of the mechanical stresses is generally proportional to the square of the peak or crest value achieved by the fault current. Thermal stresses are generally manifested in the burning of, or other thermal damage to, lines, cables, internally faulted transformers and other equipment attached to electrical systems. The mechanical stresses are manifested in the deformation of bus work and switches and in damage to items, such as transformer or reactor coils, due to the extremely high magnetic forces generated by the fault current.

Circuit switchers and circuit breakers are well-known devices for protecting high-voltage electrical systems and apparatus connected therein. These devices have high continuous current ratings, as well as substantial fault-current-interrupting capabilities. Expulsion fuses, which are also used for high-voltage circuit protection, have somewhat lower continuous-current ratings than breakers and circuit switchers. To the present, none of these devices, regardless of continuous-current rating, possess the consistent ability to limit, in all cases, both fault current peaks and $I^2t$ to low values. That is, while these devices do interrupt current, they are usually not able to limit current peaks or $I^2t$ until interruption occurs. Thus, if such devices do happen to limit current peaks or $I^2t$ to low values, it is because interruption occurs by happenstance a very short time after initiation of the fault current. For these devices to be rendered consistently capable of interrupting fault currents very shortly after initiation thereof is an expensive proposition. Accordingly, although these devices may well protect the overall high-voltage system from severe, widespread damage, some damage may nevertheless result to either the system or to the apparatus therein due to the fact that the fault current peaks and $I^2t$ may achieve substantial magnitudes prior to current interruption.

Current-limiting fuses of the so-called silver-sand variety and other current-limiting devices are well known expedients for limiting the magnitude of fault currents. See the following, commonly assigned U.S. Pat. Nos. 4,063,208 to Bernatt; 4,057,775 to Biller; 4,035,753 to Reeder; 4,028,656 to Schmunk and Tobin; 4,011,537 to Jackson and Tobin, and; 4,010,438 to Scherer. Compared to circuit-switchers, circuit breakers and expulsion fuses, current-limiting fuses both interrupt fault currents and limit peak fault current and $I^2t$ to more tolerable levels. These tolerable levels of peak fault current and $I^2t$ are lower than the values which are usually reached when circuit switchers, circuit breakers, or expulsion fuses are used. These lower values of peak fault current or $I^2t$ are often termed the "let-through current" or, simply "let through." Current-limiting fuses, therefore, are designed to (1) interrupt fault currents and (2) limit the peak fault current and $I^2t$ to tolerable magnitudes, thereby minimizing thermal and mechanical stresses. However, as is well known, current-limiting fuses, particularly at higher voltages, have low continuous-current ratings which impose limitations on the applicability thereof.

As electrical systems have expanded, and electric consumption has increased, continuous current in such systems has also increased. Because of the low continuous-current rating of conventional silver-sand current-limiting fuses, such fuses have had only limited applicability in high-voltage systems. The low continuous-current rating of current-limiting fuses is apparently inherent; known current-limiting fuses cannot meet both requirements of low let-through and high continuous-current rating without some modification or the addition of special apparatus. Further, fault-current levels have begun to exceed the capability of existing switchgear. If, in order to avoid the occurrence of increased fault-current levels, electrical systems are arranged so that they contain individual sections having low available fault currents, or, if current-limiting reactors, high impedance transformers or the like are used, certain disadvantages may nevertheless result. For example utilization of, sectionalization and the use of current-limiting reactors are uneconomical and may render voltage regulation difficult to achieve. These techniques also usually produce an over-abundance of idle reserve in the electrical system. Thus, unless an economical and reliable current-limiting fuse having a high continuous-current rating becomes generally available, the only solution—a costly one—to solve the problem of increased fault-current levels is to replace existing switchgear with gear having higher fault and overcurrent withstand capabilities and higher interrupting capabilities.

Accordingly, the fault-limiting properties of current-limiting fuses are so desirable that they have been, and remain, the subject of great interest.

Approximately twenty years ago, a device, sometimes referred to as an "$I_s$-Limiter," was developed by Calor-Emag Corporation (now a division of Brown Boveri, West Germany). The $I_s$-Limiter is constructed with a high-continous-current-capacity main conductive path which is electrically paralleled with a more or less standard current-limiting fuse. The current-limiting fuse may be of the well-known silver-sand type having a silver fusible element surrounded by a fulgurite-forming arc-quenching medium, such as silica or quartz sand.

The main conductive path of the $I_s$-Limiter includes a so-called "bursting bridge" which, upon detonation of a chemical charge contained therewithin in response to a fault current, renders the main conductive path discontinuous and rapidly transfers or commutates the current flowing through the main conductive path of the current-limiting fuse.

The bursting bridge is comprised of a pair of tube sections, each open at one end and containing longitudinal slots over the majority of their length. The open ends of the tube sections are joined along a brazed, weak interface to enclose the chemical charge. Detonation of the chemical charge breaks the weak interface, blowing up the bursting bridge and bending fingers defined between the solts of each tube section out and back in a "banana peel" configuration; this renders discontinuous the main conductive path. See U.S. Pat. No. 2,892,062 to Bruckner, et al. This discontinuity in the main conductive path transfers or commutates the current to the current-limiting fuse, which current is then interrupted in a conventional manner common to silver-sand current-limiting fuses. The chemical charge is detonated by means of a pulse transformer, or other electronic device, contained in one of two insulators which mounts the combination of the current-limiting fuse and the main conductive path, each housed in its own individual insulative housing.

When the bursting bridge is blown apart, an arc forms between the tube sections. The arc voltage is, sometime thereafter, sufficiently high to commutate the current to the fusible element so that interruption in the current-limiting fuse may occur. If not properly fabricated, the bursting bridge may not fully open. Further, it has been found that the gap between the bent-back fingers of the tube sections may be ionized by hot ignition products, mostly gaseous, due to detonation of the chemical charge. Such ionization permits the arc to persist and/or lowers the arc voltage, thus slowing or preventing commutation of the current to the current-limiting fuse. It has also been found, however, thay by careful design and construction the dielectric strength across the gap usually recovers, or at least usually increases rather quickly, after about 200 microseconds. Therefore, the fusible element of the current-limiting fuse portion of the $I_s$-Limiter must be so designed and constructed at to (a) overlap the "dead time" of the bursting bridge until the 200 microsecond time passes, and then (b) limit and interrupt the current. Following the initial 200 microseconds, voltage stress across the gap has been found to be rather low, due to the lower resistance of the fusible element as compared to that of the gap. Thus, the $I_s$-Limiter is a current-limiting device combining a fast-acting switch having a high-continuous-current capability but poor current-interrupting capability, with an electrically parallel current-limiting fuse having a low-continuous-current capability but high current-limiting and interrupting capability.

Several disadvantages of the $I_s$-Limiter should be noted. First, the current-limiting fuse and the main conductive path form two separate elements in their own separate housings. This arrangement is not only somewhat clumsy and difficult to manipulate during replacement or initial placement, but increases material costs due to the duplication of certain elements, such as housings, end ferrules, conductors, and the like. Second, commutation of the current flowing through the main current path to the current-limiting fuse may be slower than it might otherwise be, because the inductance of the main conductive path and current-limiting fuse combination is relatively high. Third, there is a practical limitation to the gap that can be formed by the bursting bridge. Specifically, only so much chemical charge may be confined within a practical volume of the bursting bridge to ensure that the fingers defined by the slots in the two tube sections are sufficiently blown outwardly and bent backwardly. That is, the tube sections could be greatly elongated and filled with a chemical charge of larger size so that its detonation bends back fingers of increased length to produce a longer gap. Both the increased size of the charge and the increased length of the fingers, however, require a larger diameter housing of higher burst-strength, adding to the cost and inconvenience of the overall device. Fourth, as already noted, some rather precise coordination between the operation of the current-limiting fuse of the $I_s$-Limiter and the dielectric recovery of the gap formed between the tube sections is necessary. Due to the vagaries of fault-current conditions in high-voltage circuits, this coordination may prove difficult to achieve.

A complete discussion of the $I_s$-Limiter may be found in the following documents: "A Current-Limiting Device for Service Voltages Up to 34.5 kv" by Keders and Leibold, Paper A76 436-6, presented at the IEEE PES Summer Meeting, Portland, Oreg., July 18–23, 1976; "Limiting Fault Currents Between Private and Public Networks" by Blythe, *The Electrical Review* (Great Britain), Oct. 5, 1973; "Fault Levels Too High?" an English Language publication put out by Calor-Emag Corporation as Leaflet No. 1197/6E; "The Application of $I_s$-Limiters in Three-Phase Systems" by Böotger, a publication of the Calor-Emag Corporation, circa August 1967; and "The Economic Benefits of Using $I_s$-Limiters" by Heilmann, a publication of the Calor-Emag Corporation, circa February 1963.

Other types of circuit interrupters utilizing the blowing apart of a conductor by an explosive charge are disclosed in the following: U.S. Pat. Nos. 466,761 to Wotton; 1,856,701 to Gerdien; 2,175,250 to Burrows et al; 2,548,112 to Kaminky; 2,551,858 to Stoelting et al; 3,400,301 to Misare; 3,851,210 to Kozorezov et al; 3,958,206 to Klint; and French Pat. No. 2,262,393 to Grebert.

Some general improvement of devices similar to the $I_s$-Limiter has been effected, as described by Pflanz, Clark, and Laboni, in "A New Approach to High-Speed Current Limitation," presented in the Symposium Proceedings, New Concepts in Fault-Current Limiters and Power Circuit Breakers, printed in a special report of the Electrical Power Research Institute, Paper EPRI EL-276-SR, in April 1977.

In the Pflanz et al device, a fusible element is embedded in and surrounded by a fulgurite-forming particulate medium, such as silica sand, to form a current-limiting fuse apparently of more or less standard design. The fusible element is electrically paralleled with a large-cross-section copper conductor which constitutes a main current-path. The fusible element and the conductor are contained in a common insulative housing. The large-cross-section conductor is surrounded by, and has wound around it, a so-called "linear charge" which, upon detonation, cuts through the large-cross-section conductor to create a plurality of gaps therein. The formation of these gaps commutates the current normally flowing through the conductor to the fusible element for current-limiting interruption of a fault current. Detonation of the linear charge is initiated by a sensor/initiator, which is described only as a "fuse primary charge," responsive to either current flowing through the large-cross-section conductor, or to the output of a current transformer. According to Pflanz, et al, the sensor and initiator may be either contained within the common housing for the device or externally thereof. As should be apparent, the Pflanz, et al, device operates substantially externally the same as the $I_s$-Limiter except that plural gaps are formed in the main current-conductor prior to current-limiting circuit interruption by the current-limiting fuse. The Pflanz, et al, device suffers at least two of the shortcomings of the $I_s$-Limiter. Specifically, although numerous gaps are formed in the main conductive path, the length of these gaps is nevertheless limited by the ability of the linear charge to render the large-cross-section conductor discontinuous. There is a practical limit to the dimensions these gaps may achieve; apparently the gap dimensions are quite small. Thus, it would seem that the possibility exists for restriking of arcs in the small gaps, should the arc voltage in the current-limiting fuse reach high levels. Second, although the Pflanz, et al, device decreases the inductance of the overall device, as compared to the $I_s$-Limiter, by placing the fusible element and the main conductive path in the same housing, reduction of such inductance has not been optimized.

Other devices related to the $I_s$-Limiter and to the Pflanz, et al, device, either by their use of chemical charges or by their parallel arrangement of current paths, are also known. A summary follows.

It is known to ignite or detonate a chemical charge with heat caused by a fault current, the exothermic ignition of the charge melting or breaking a member. The member normally restrains movement of an element; melting or breaking of the member permits a stored energy source or spring to perform work, such as moving the element to operate a circuit breaker operating lever. See U.S. Pat. No. 1,917,315 to Biermanns et al.

It is broadly known to move a contact and close a circuit by the detonation of a chemical charge. In U.S. Pat. No. 3,184,726 to Hellgren, detonation of a pyrotechnic mixture pressurizes a housing. The end of a bellows forming a part of the housing is moved by such pressurization. The bellows end ultimately engages a grounded contact to ground a circuit which includes the housing therein.

In U.S. Pat. No. 2,721,240, to Filbert, detonation of an explosive charge everts or deforms a ductile, conductive diaphragm. Eversion or deformation of the diaphragm causes it to engage and electrically interconnect a pair of separated contacts, thus completing a circuit therebetween.

Perry and Frey in an article entitled "Ultra-High Speed Ground Switch Application and Development" (AIEE Paper No. 62-1109, presented in Denver, Colo., in June 1962) describe a ground switch having a lightweight blade (e.g., aluminum tubing) connected to a piston of a piston-cylinder. The cylinder contains an electrically firable propellant cartridge, the firing circuit for which contains a normally open switch. When a sensor detects a predetermined condition in a high-voltage system, the normally open switch is closed to fire the cartridge. Firing of the cartridge pressurizes the piston-cylinder to rapidly move the piston. Rapid piston movement rapidly pivots the blade on an electrically grounded hinge into engagement with a mating contact connected to the high-voltage system. The system is thus grounded.

McMorris, U.S. Pat. No. 2,305,436, described a fuse device, which includes a fusible element in electrical series with an inductor, the series combination being in electrical parallel with a spark gap. The fusible element is surrounded by an explosive charge (e.g., gunpowder) contained within a cardboard housing. The inductor physically surrounds the spark gap and the cardboard housing. One side of the fusible element is electrically and physically connected to one electrode of the spark gap. Acting between the one electrode and a terminal of the device is a spring, which also is a current path between the one electrode and the terminal. All elements are in an insulative housing closed by a porcelain disk cemented thereto near the terminal. If the device is subjected to a prolonged surge, the spark gap first breaks down and conducts because of the voltage developed across the inductor. Subsequently, the gap ceases conduction and current flows through the inductor and the fusible element, blowing the fusible element to detonate the explosive charge. Detonation of the charge fractures the cement joint between the disk and the insulative housing, permitting the spring to expel the terminal from the housing.

In U.S. Pat. No. 1,917,315 to Murray, a high tension fuse includes a hollow tube having a pair of low mass plungers therewithin. It is not clear if the plungers are insulative or conductive. A fusible element runs the length of the tube through the plungers and has a "blowing point" between the plungers. A quantity of gun cotton may be on one of the plungers near the blowing point. When a fault current occurs in a circuit to which the fusible element is connected, gas generated by the fusing of the blowing point, and by detonation of the gun cotton effected by such fusing, drives the plungers apart. The plungers carry with them portions of the fusible element passing therethrough.

Curry, in U.S. Pat. No. 2,491,956, discloses a circuit interrupter having a high resistance path in electrical shunt with a low resistance path. The low resistance path includes, in series, a terminal, a bimetallic element, a first movable contact on the element, a second movable contact normally engaged by the first movable contact, a movable contact rod mounting the second movable contact, and a sliding contact continuously electrically connected to the contact rod. The contact rod and the second movable contact are biased for movement away from the first movable contact by a spring. This bias is normally resisted by a fusible strain wire. The high resistance path includes, in series, the terminal, the strain wire, a portion of the contact rod, and the sliding contact. Excessive current flow through the interrupter heats the bimetallic element, causing it to flex and disengage the first movable contact from the second movable contact. This, in turn, transfers the current to the strain wire, which fuses, permitting the spring to move the contact rod and the second movable contact away from the first movable contact. Such movement elongates the arc between the movable contacts in an arc-extinguishing environment to interrupt the excessive current.

None of the above references disclosed devices intended for current-limiting circuit interruption. Moreover, some of them (Hellgren, Filbert, and Perry and Frey) are either low-voltage devices or are "close only" switches or grounding switches. In Biermanns, et al, only the heat energy of a chemical charge is utilized; in McMorris, detonation of an explosive charge is primarily utilized to disintegrate a housing so that a spring may expel a terminal; Curry uses no chemical charge or explosive at all. In Murray, the electrical connection between two plungers is first broken, following which the plungers move apart. As will soon be apparent, the present invention involves, in part, movement apart of two contacts, following the inception of which movement, normal electrical interconnection therebetween is broken by the movement. Lastly, all of these prior art devices are complicated, are unsuitable for high-voltage circuit interruption, are of doubtful operability, or all of these.

The invention disclosed in commonly assigned U.S. patent application, Ser. No. 972,650, filed Dec. 21, 1978 in the name of Otto Meister is an improvement over all of the previously discussed devices. Specifically, an improved high-voltage device having a high continuous-current rating, may include both a fuse and an improved switch. The device has a first, high-current-capacity path and a second, low-current-capacity path surrounding the first path in a compact configuration. Current is selectively commutated from the first path, which may include the switch, to the second path, which may include the fuse. The improved switch has a pair of normally electrically interconnected contacts. The contacts are relatively movable apart along a fixed line of direction to break the electrical interconnection. The contacts define an enclosed chamber. The chamber may be pressurized by ignition of a power cartridge therein to rapidly drive and move the contacts apart. Preferably the improved device comprises a current-limiting fuse which helically, coaxially surrounds the improved switch in a common housing.

The device and switch of the '650 application do not depend upon the mere fracturing (or blowing apart) and peeling back of portions of a main current path, as is the case with some prior art devices, but rather, utilize the positive driving and moving apart of the contacts, ensuring that a large gap is opened therebetween. The surrounding relationship of the current paths not only decreases to a minimum the inductance of the overall device, but further, minimizes the number of directional changes which the commutated or transferred current experiences, keeping the current flowing in the same direction in the second current path as it flowed in the first current path. Further, the surrounding relationship renders the fuse convenient to fabricate and assemble.

While the invention of the '650 application represents an improvement over the above-discussed prior art devices, it is recognized that refinements thereof are possible, and, perhaps, desirable. For example, although contact movement apart permits the formation of a long gap, hot ignition products of the power cartridge may permit or encourage arcing therebetween to persist and/or lower the arc voltage. Both effects may slow or prevent commutation of the current to the second current path; means of obviating this result—suppressing or extinguishing the arc, elevating the arc voltage, or opening additional gaps in the first current path—are only generally suggested in the '650 application.

Moreover, im the invention of the '650 application, the enclosed chamber is defined by the contacts which have blind holes therein. The contacts normally engage along an annular interface, the blind holes defining the enclosed chamber. The interface may include a conductive medium, or be brazed or soldered, to ensure normal electrical conduction between the contacts. Such conduction may also be ensured by only generally described breakable, tearable or frangible conductive members. The intent of the '650 invention is that pressurization of the chamber by the power cartridge separates the contacts along the interface, or breaks the conductive members, where used. In devices according to the '650 application the interface may not always predictably separate.

Accordingly, a primary object of the present invention is to improve and refine the '650 invention, including the following objects:

(1) To positively ameliorate or obviate the effects of the ignition products of the power cartridge;

(2) To ensure current commutation to the second current path by suppressing or extinguishing any arc forming, or tending to form, between the separated contacts;

(3) To restructure the annular interface between the contacts—eliminating the need for the conductive medium, soldering or brazing—and both ensure that the contacts can rapidly move apart in a predictable fashion, while eliminating the need for the interface to carry current between the contacts; and (4) To restructure the chamber so that its pressurization more effectively drives the contacts apart.

A further object of the present invention is the provision of a high-voltage fuse having a high continuous current rating. Yet another object of the present invention is a high-voltage fuse having the following properties: convenient, expeditious and economical manufacture; reliable operation; simplification and minimization of parts; minimization of inductance; and reliable formation of a gap in a main conductive path which ensures current commutation to a fusible element. An additional object of the present invention is the provision of a switch for use in the main conductive path, in which switch a pair of normally electrically interconnected contacts are moved apart by ignition of a charge in a chamber, the movement breaking the electrical interconnection therebetween.

SUMMARY OF THE INVENTION

With the above and other objects in view, the present invention relates to both an improved high-voltage electrical switch and to an improved high-voltage device utilizing the switch, all as generically described and claimed in the '650 application. The switch functions to open a first current path within the device and includes first and second normally electrically interconnected contacts. The contacts are relatively movable apart along a fixed line of direction. Movement of the contacts apart breaks the normal electrical interconnection therebetween to open the first current path. When the contacts are electrically interconnected, an enclosed chamber is defined. The chamber may be selectively pressurized to move the contacts. Preferably, within the chamber is contained an ignitable chemical charge or power cartridge, which, upon ignition, rapidly evolves high-pressure gas. The evolution of the high-pressure gas acts on the chamber to rapidly drive and move the contacts apart. When the first current path is opened, current flowing therein is shunted to a second current path, which may include a current-limiting or non-current-limiting fuse, preferably coaxially surrounding the switch, or other elements, such as a current-limiting resistor.

The chamber is defined by the first contact and an electrically non-conductive piston carried by the second contact. Preferably, the piston is configured to normally fit within and sealingly engage the walls of a pocket formed in the first contact, thus ensuring that the ignition products of the power cartridge are effective in driving the contacts apart. The normal electrical interconnection between the contacts is effected by one of two expedients. Either the second contact may fit within and engage the walls of the pocket, or, a highly conductive member may electrically interconnect the contacts whether the pocket is present or not. In the former case, one or both contacts may comprise spring fingers biased to ensure good electrical contact, although proper sizing of the second contact and the pocket may achieve this same end. In the latter case, the conductive member may be rendered tearable or frangible by perforations therein, or, a stationary shearing member may be provided which, upon relative movement of the contacts, severs the conductive member.

In preferred embodiments, the second contact moves through a tube of an ablative, arc-extinguishing material. The tube is sized similarly to the pocket so that the piston sealingly engages its walls as it does the walls of the pocket. Preferably the pocket and the tube are contiguous. Accordingly, as the contacts move apart and the electrical interconnection therebetween is broken, the second contact is physically isolated from the first contact by the piston and its engagement with the tube. This isolation limits the possible arc-encouraging effects of the ignition products of the power cartridge, and forces any arc forming, or tending to form, between the contacts to pass between the tube and the piston. If such an arc does form, it is constricted ("squeezed" or "strangled") between the piston and the tube which, in conjunction with the arc-extinguishing properties of the tube, results in extinguishment of the arc. To further enhance this arc-extinguishing effect, the piston may also be made of an ablative, arc-extinguishing material. Thus, the piston and the tube may function as the so-called "trailer" and "liner", respectively, of a "trailer-liner" circuit interrupter function. Such an interrupter is in generally known, and is generally described in commonly assigned U.S. Pat. No. 2,954,448. Of course, it is possible that the sealing engagement of both the pocket and the tube by the piston will prevent an arc from forming or persisting in the first place, especially since the cartridge's ignition products are isolated from the second contact.

In specific, preferred embodiments of the device and of the switch, the piston is made of an electrically insulative, low friction material, having arc-extinguishing properties and being sufficiently flexible to be forced by the pressure generated by the power cartridge into intimate engagement with the pocket and the tube. Desirably, the material of the piston must also be able to withstand the heat produced by both ignition of the power cartridge and any arc that forms. A preferred material is polytetrafluoreathylene ("Teflon") which has a sufficiently poor elastic memory to ensure that, once forced into engagement with the tube, such engagement does not decrease. The annular conductive member is preferably a stepped silver ring. A larger diameter portion of the ring is normally attached to the first contact about the entrance to the pocket. A smaller diameter portion of the ring is attached to the second contact on a side thereof opposite from the point of attachment of the piston thereto. The ring contains perforations which enhance its severability by an annular cutting member stationarily mounted to the first contact.

In further specific embodiments of the device, a first insulative housing completely encloses the power cartridge and both current paths. Terminals at either end of the first current path are fixed to and extend beyond the first housing, the terminals being connectable to a high-voltage electrical circuit. Each contact is continuously electrically connected to its respective terminal. A second insulative housing within the first housing encloses the contacts, the ignitable chemical charge and the first current path. The housings define an annular compartment in which the current-limiting or non-current-limiting fuse is contained.

Figure 1:
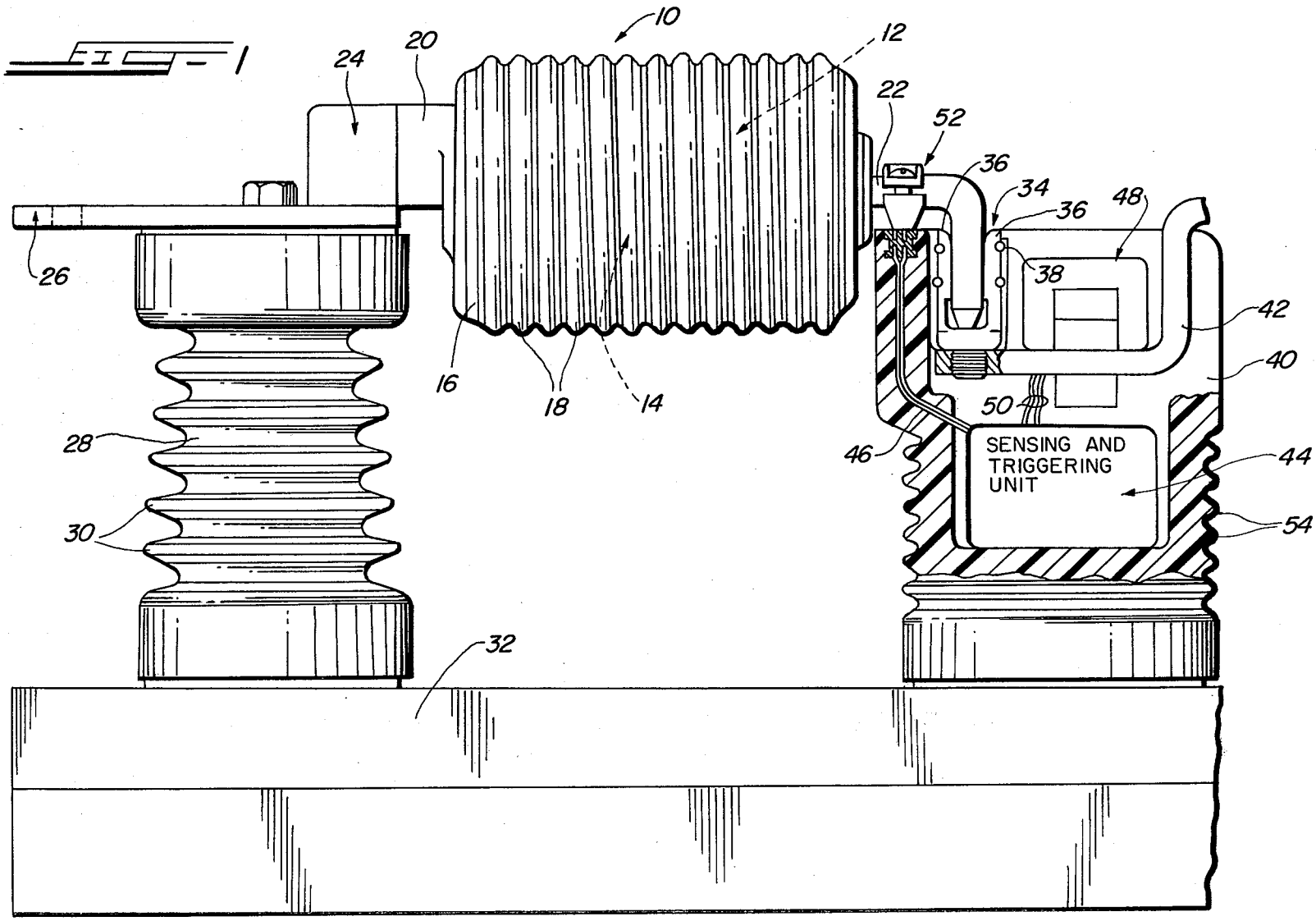
FIG. 1 is a general, exterior view of a novel high-voltage device in accordance with the principles of the present invention; the device is mounted between a pair of insulators, one of which is partially sectioned to generally depict a sensing and triggering unit contained therein.
Figure 5:
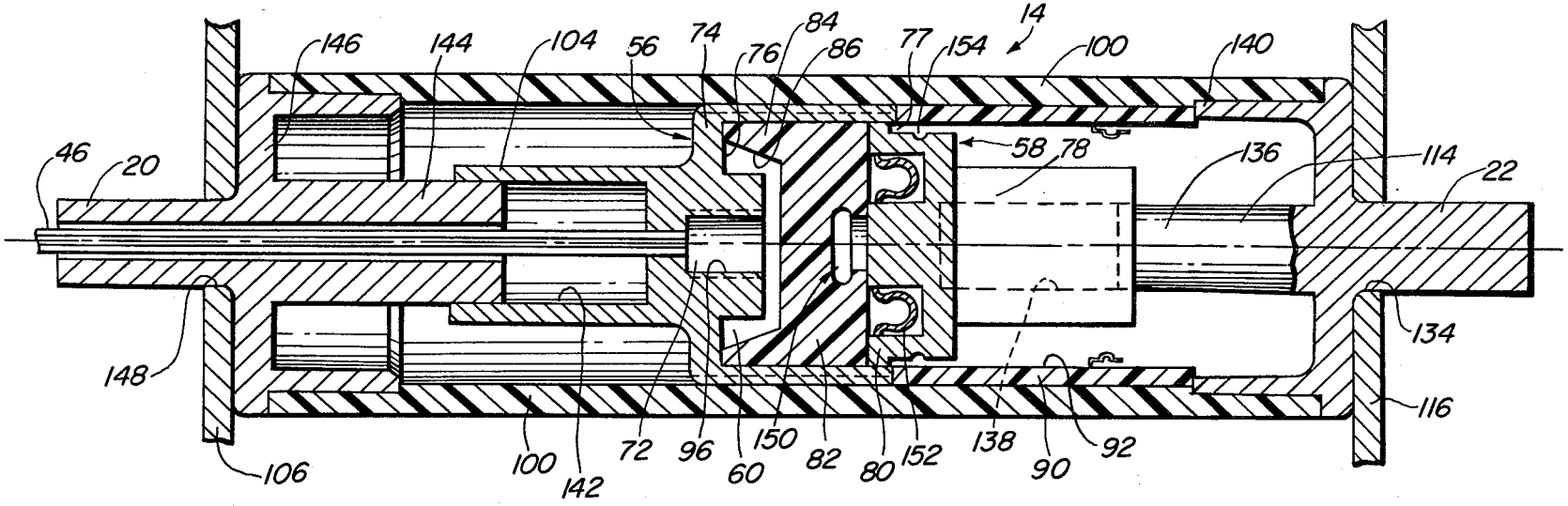
Figure 4:
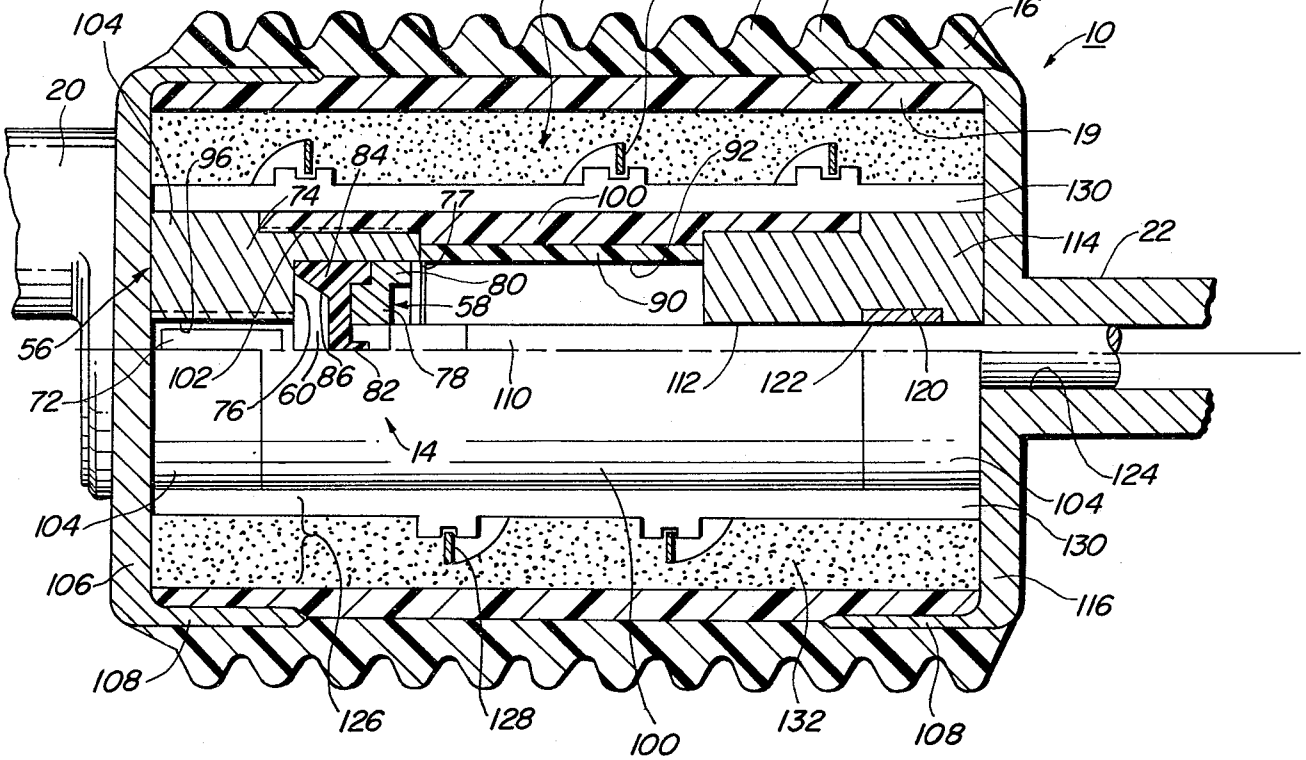
Figure 6:
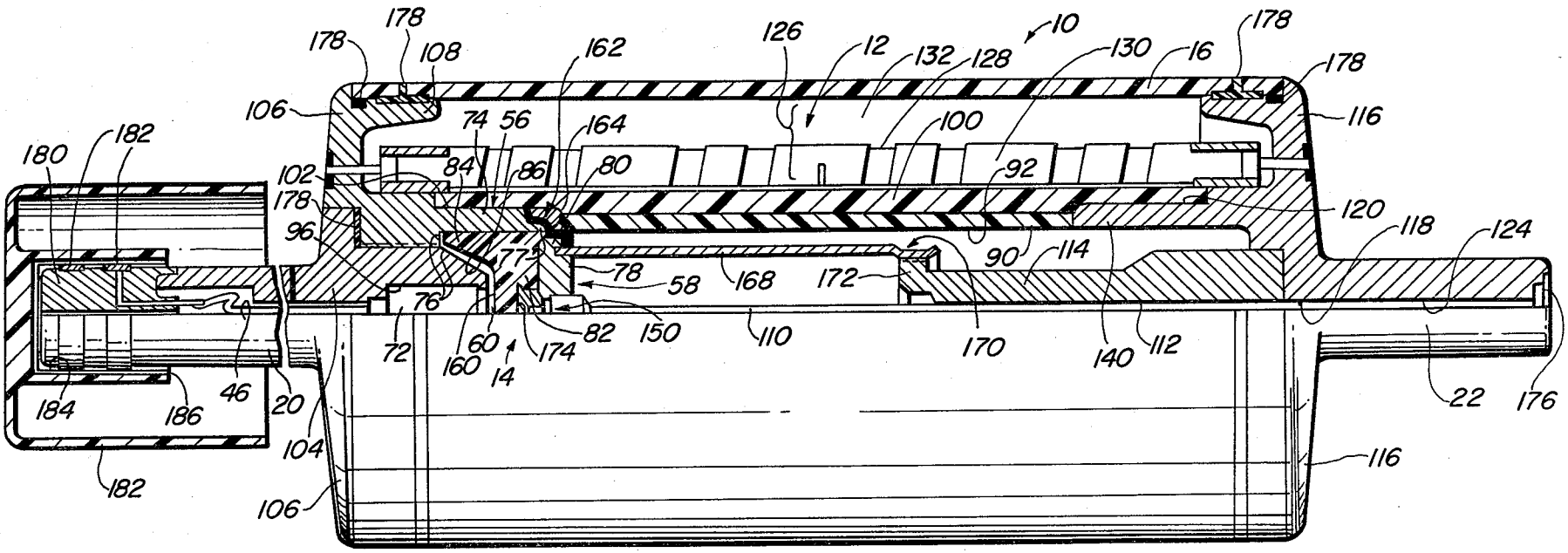

FIGS. *2a* and *2b* are simplified electro-mechanical schematic depictions of the device shown in FIG. 1 including a generalized representation of a novel switch and a fuse;

FIGS. *3a–3c* are side elevational, partially sectioned, generalized representations of the novel switch of FIGS. *2a* and *2b*, illustrating the condition thereof at different times during its operation;

FIG. 4 is a side elevational, partially sectioned view of one embodiment of the device of FIG. 1, showing one embodiment of the novel switch together with a current-limiting fuse;

FIG. 5 is a side elevational, partially sectioned view of another embodiment of the switch according to the present invention;

FIG. 6 is a side elevational, partially sectioned view of a preferred embodiment of the device of FIG. 1 showing a preferred embodiment of the novel switch together with a current-limiting fuse; and FIGS. *7a–7c* include a top, side and bottom view of a portion of the novel switch shown in FIG. 6.

DETAILED DESCRIPTION

Referring first to FIG. 1, there is shown a general exterior view of a novel high-voltage device 10 in accordance with the principles of the present invention. The novel device 10 may include a high-voltage fuse 12 and a novel high-voltage switch 14, both contained within an elongated insulative housing 16. The fuse 12 may be either a current-limiting or non-current-limiting, although the former is preferred. As is well known, the housing 16 may contain a plurality of leakage-distance-increasing skirts 18, and may be made of porcelain or other suitable insulative material, such as molded cycloaliphatic epoxy resin. The housing 16 may surround, and be either attached to or formed integrally with, an inner housing 19 (See FIGS. 4 and 6). The inner housing 19 is preferably made of glass fiber and epoxy.

Extending from the left end of the housings 16 and 19 may be a first terminal 20, which is connected to various elements therewithin in a manner to be described below. Extending from the right end of the housings 16 and 19 is a second terminal 22 which is also connected to elements within the housings 16 and 19. The terminals 20 and 22 may take configurations other than those depicted in the Figures or described below.

The terminal 20 is detachably connectable, in any convenient fashion, to a mounting facility 24 which may be formed integrally with, or is otherwise suitably connected to, a cable- or line-attachment facility 26. One cable or line (not shown) of a circuit (not shown) to be protected by the device 10 is attached in any convenient manner to the facility 26. The mounting facility 24 and the cable-attachment facility 26 are supported by, and are attached to, a support insulator 28 formed of porcelain or other convenient insulative material, such as cycloaliphatic epoxy resin. The insulator 28 may contain a plurality of leakage-distance-increasing skirts 30, and is supported on a common base 32 which may be a structural steel member or the like.

The terminal 22 may take any convenient configuration, the inverted L-shape depicted in FIG. 1 being one example thereof. The terminal 22 is detachably engageable by a mounting facility 34. If the terminal 22 takes the generally circular cross-section depicted in FIG. 1, the mounting facility 34 may comprise a plurality of contact fingers 36 (only two are shown), spring biased into intimate engagement with the terminal 22 by one or more garter springs 38. The mounting facility 34 may be molded-in as an integral part of an insulator 40 which may be made of porcelain, a cycloaliphatic epoxy resin or other suitable insulative material. Also contained within the insulator 40 may be a conductor 42 which is continuously connected to the fingers 36 and which is connectable to another cable or line (not shown) of the circuit (not shown) being protected by device 10.

Also contained within the insulator 40 may be sensing and triggering unit 44. The sensing and triggering unit 44 generates appropriate output signals on output conductors 46, for a purpose to be described below, in response to the condition of the current in the conductor 42, which may be sensed by a current transformer 48 connected to the unit 44. The unit 44 and the transformer 48 may be integrally molded into the insulator 40. The current transformer 48 and the sensing and triggering unit 44 are interconnected by appropriate leads 50. The unit 44 may include a "current zero sniffer" which applies, at a selected time with reference to a current zero, a signal to the conductors 46 in the event of an overcurrent in the circuit connected to the facility 26 and the conductor 42.

The output conductors 46 of the sensing and triggering unit 44 may pass through the insulator 40 to an appropriate detachable clamp 52 detachably surrounding the terminal 22. The output conductors 46 may then enter the interior of the housings 16 and 19 through the terminal 22 which may be hollow or bored for this purpose. The insulator 40 may contain a plurality of leakage-distance-increasing skirts 54 and is attached to the common mounting base 32.

The present invention contemplates the unit 44 and/or the transformer 48 being in locations other than those shown. For example, the unit 44 may be within the housing 16 or in a separate housing (not shown) attached to or formed integrally with the housing 16. In this latter event, the structure of the terminal 22, the mounting facility 34 and the insulator 40 may vary from that depicted in FIG. 1.

The insulators 28 and 40, on the one hand, and the device 10, on the other hand, are shown in FIG. 1 as having, respectively, vertical and horizontal orientations. Any of these components may be mounted in any other desired orientation, as should be obvious. The unit 44 and the transformer 48 may be reusable; it is contemplated that only the fuse 12 and the switch 14 require replacement following operation of the device 10.

Figure 2B:
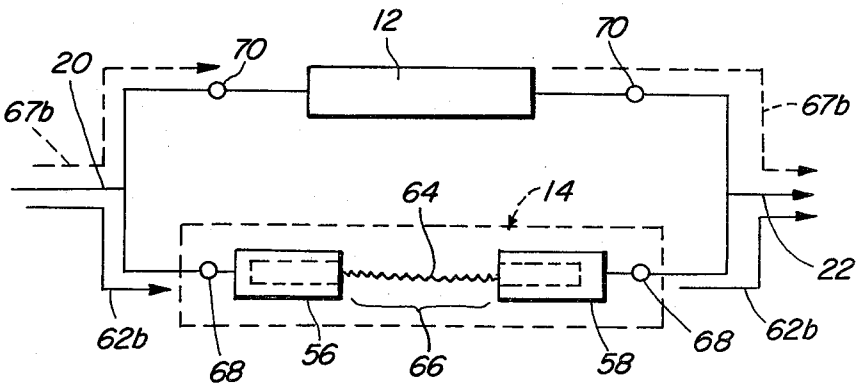

Referring now to FIG. 2, there is shown a schematic view of a simplified version of the novel high-voltage switch 14 and the high-voltage fuse 12, which together comprise the high-voltage device 10 of the present invention. A more complete description of the switch 14 and of the device 10 in their most generic forms may be found in the aforementioned '650 application.

Figure 2A:
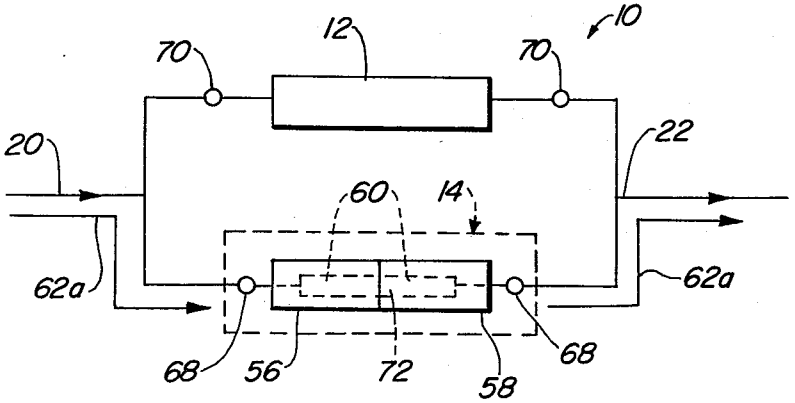

The switch 14 includes a pair of contacts 56 and 58 relatively movable apart along a fixed line of direction. The contacts 56 and 58 are normally positioned (FIG. 2*a*) so as to be electrically interconnected by a conductive metallic connection. The metallic connection may take numerous forms, exemplary of which are: direct physical engagement of the contacts 56 and 58 (as shown in FIG. 2), a quantity of conductive material in a small space between the slightly separated contacts 56 and 58; or one or more conductive members attached between the contacts 56 and 58. The first two expedients are preferred in the '650 application; the first and third expedients are preferred for use in the present invention.

When the contacts 56 and 58 are normally positioned so as to be electrically interconnected by the metallic connection (whatever its form), at least one of them (or a portion thereof, or a member thereon) defines, or contributes to the definition of, an enclosed chamber shown only generally at 60. The chamber 60 is pressurizable to drive the contacts 56 and 58 farther apart than they are in their normal positions. Parting movement of the contacts 56 and 58 breaks the normal electrical interconnection by rendering discontinuous the conductive metallic connection. Depending on the voltage and current at which the switch 14 is used, the breaking of the normal electrical interconnection between the contacts 56 and 58 may or may not interrupt such current (arrow 62*a* in FIG. 2*a*). For example, as is well known, if the voltage is sufficiently high, rendering discontinuous the normal metallic connection may result in the formation of an arc 64 between the contacts 56 and 58 (See FIG. 2*b*). Until the arc 64 is extinguished, current continues to flow in the switch 14 (as shown by the arrow 62*b* in FIG. 2*b*) even though the metallic connection has been broken. If the arc 64 forms, it develops an arc voltage, which may be viewed as a hinderance to current flow. If the arc 64 does not form, there is between the contacts 56 and 58 a gap 66 having a very high (nearly infinite) impedance to current flow.

In preferred embodiments, as detailed below, the normal series combination of contact-interconnection-contact has a low resistance or impedance and a high current-carrying capacity. This series combination may be shunted by a higher impedance conductive path, through which little current normally flows. When the contacts 56 and 58 move apart to break the normal electrical interconnection therebetween, it is intended that current be commutated or transferred to the shunt path (as shown by the arrow 67*b* in FIG. 2*b*), which has a lower impedance to current flow than either the arc 64, or the gap 66 between the contacts 56 and 58 if the arc 64 does not form. Extinguishment or suppression of the arc 64 that may form is desirable. Accordingly, the arc 64 may be made to form in the vicinity of an arc-extinguishing medium, including ablative solids (such as boric acid) or fluids (such as $SF_6$). As is well known, such media either extinguish or suppress the arc 64, or both, as generally discussed in the '650 application. The present invention relates, inter alia, to specific techniques for extinguishing or suppressing the arc 64.

The contact-interconnection-contact series combination of the switch 14 is referred to herein as a "first current path" 68. The shunt path, which contains the fuse 12, is referred to herein as a "second current path" 70. Considering the switch 14 by itself, and not in conjunction with the second current path 70, the phrase "opening the first current path" 68 refers to the parting movement of the contacts 56 and 58 and the concomitant breaking of the normal metallic connection therebetween, without regard to whether the arc 64 forms, or, if it does form, whether it is extinguished or not. Considering the combination of the switch 14 and the second current path 70, the commutation of current from the first current path 68 to the second current path 70 may be viewed as the result of "breaking the interconnection" or of "opening the first current path" 68. Thus, both phrases may also refer to the breaking of the metallic connection and the resulting current commutation of the shunt path 70; neither phrase is intended to imply that current flow 62*a* or 62*b* in the switch 14 is necessarily interrupted by only the movement apart of the contacts 56 and 58, for as noted earlier, the arc 64 may well form. Of course, following current commutation and the cessation of current flow 62*a* or 62*b* in the switch 14, no current will again flow thereafter in the switch 14, regardless of what occurs in the shunt path 70, if the dielectric strength of the gap 66 between the parted contacts 56 and 58 is sufficiently high.

To iterate, as used herein, the phrase "electrically interconnected," as it refers to the contacts 56 and 58, means the following:

(1) The contacts 56 and 58 are electrically continuous, either (a) because of their physical engagement, or (b) because of conductive media or members (not shown) attached therebetween, whether or not the contacts 56 and 58 are physically engaged; and (2) When the contacts 56 and 58 are so electrically continuous, at least one contact (or a portion thereof or a member thereon) defines the chamber 60.

Facilities are provided to selectively pressurize the chamber 60 to drive the contacts 56 and 58 apart. The chamber 60 may contain a quantity of an ignitable chemical charge, which preferably takes the form of a so-called power cartridge generally indicated at 72, which effects such selective pressurization.

The power cartridge 72 may assume any convenient configuration. As is well-known, the power cartridge 72 may constitute a so-called pressure cartridge which is capable of generating energy for any system requiring work. Such cartridges 72 usually include a unit, hermetically sealed or otherwise, containing smokeless powder (not shown) or the like and a fusible bridge wire (not shown), the heating or fusing of which ignites the powder. Power cartridges are ignitable by low currents flowing through the bridge wire, typically in the 5-ampere range. Such cartridges 72 are available from comma inter alia, Quantic Industries, Inc. of San Carlos, Calif., and Holex, Inc. of Hollister, Calif. Previously noted U.S. Pat. Nos. 3,851,219 and 3,400,301, and French Pat. No. 2,262,393 describe the general use of such cartridges in fuses or fuse-like device. The following previously cited articles also provide additional background on the use of power cartridges: "A Current-Limiting Device for Service Voltages Up to 34.5 kV" by Keders and Leibold, paper A76436-6, presented at the IEEE PES Summer Meeting, Portland, Oreg., July 18–23, 1976; "Limiting Fault Currents Between Private and Public Networks," by M. C. Blythe in Electrical Review (U.K.), Oct. 5, 1973; and "Fault Levels Too High?" leaflet number 1197/6E of Calor-Emag Electrizitats-Aktiengessellschaft, Ratingen, West Germany.

The output conductors 46 of the sensing and triggering unit 44 (FIG. 1) are appropriately connected to the bridge wire (not shown) of the power cartridge 72 (FIG. 2) for ignition thereof at an appropriate time, as hereinafter described.

Referring to FIG. 3, there is shown a generalized representation of a portion of one embodiment of the novel switch 14 of the present invention. Although specific embodiments of the switch 14 depicted in other Figures vary to some extent from FIG. 3, this Figure is herein described in order to generally explain certain details of this invention common to all embodiments.

The contact 56 may comprise a cup-shaped member 74, the left end of which is electrically connected to the terminal 20 at the left of the housings 16 and 19; this connection is shown only schematically in FIG. 3. The number 74 is stationarily mounted as appropriate to the terminal 20, the housings 16 and 19, or both. The member 74 may define a pocket 76 having one end 77 open.

Figures 3A, 3B, 3C:
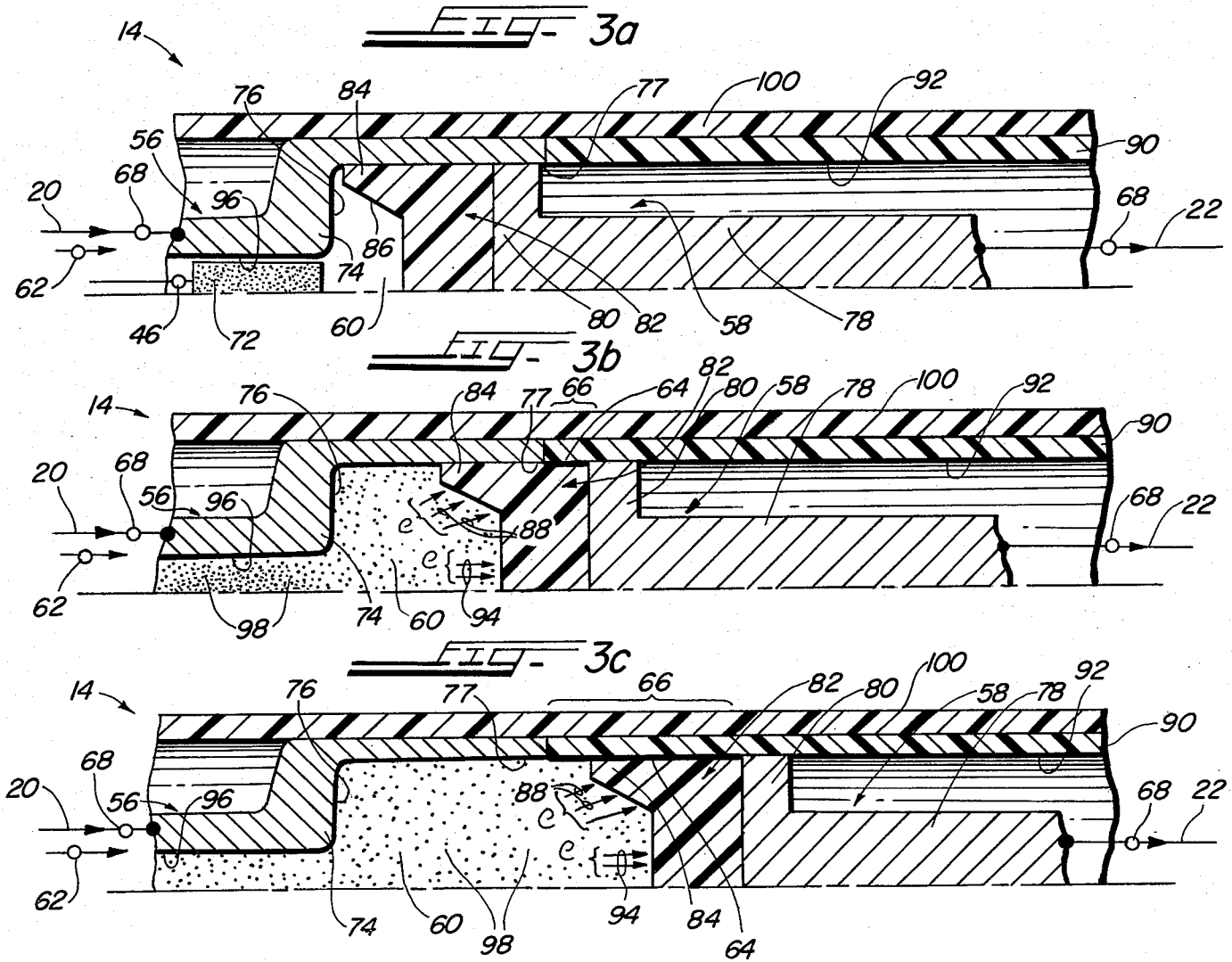

The contact 58 comprises a movable conductive member 78 which may have a portion or enlargement 80 thereof which fits into, and engages the walls of, the pocket 76 in the normal condition of the switch 14. Carried by the member 78 or by the enlargement 80 in any convenient manner is a piston 82. The piston 82 is configured and sized so as to intimately engage the walls of the pocket 76 when the contact 58 is normally positioned as shown in FIG. 3*a*.

The piston 82 may include a lip or flange 84 in engagement with the walls of the pocket 76. An interior surface 86 of the lip 84 is sloped or otherwise configured so that a pressure build up on the chamber 60, defined between the pocket 76 and the piston 82 applies force to the surface 86 as shown by the letter $\rho$ and the arrows 88 in FIGS. 3*b* and 3*c*. Such force ensures that the lip 84 remains in intimate engagement with the walls of the pocket 76.

A tube 90 having an interior bore 92 extends away from and encloses the end 77 of the pocket 76. The bore 92 of the tube 90 has the same size, and is contiguous with the walls of, the pocket 76 so that the pocket 76 and the bore 92 form a continuous passageway of the same diameter. The same pressure build up in the chamber 60 which applies force to the surface 86, also applies a moving force to the piston 82 as shown by the letter $\rho$ and the arrows 94 in FIGS. 3*b* and 3*c*. This moving force progressively moves the piston 82 and the contact 58 rightwardly from their position in FIG. 3*a* to the positions of FIGS. 3*b* and 3*c*. During such movement, the contact 58 remains electrically continuous with the terminal 22, as only schematically indicated in FIG. 3, by appropriate facilities (not shown) such as sliding contacts, flexible conductors, or the like. The current carrying ability of the contacts 56 and 58 and of all elements in the first current path 68 may be made quite high by appropriate selection of materials and cross-sectional areas. During movement of the contact 58 and the piston 82, the lip is held in intimate engagement with both the walls of the pocket 76 and the walls of the bore 92 by the forces indicated by the arrows 88. Thus, as the contact 58 and the piston 82 move, the chamber 60 enlarges, but remains enclosed.

The pressure build-up in the chamber 60 may be selectively effected by ignition of the power cartridge 72 which may be located adjacent the pocket 76 in a compartment 96 defined by the member 74 and continuous with the pocket 76. The power cartridge 72, or other pressure source, may be located elsewhere and communicate with chamber 60 by appropriate expedients (not shown).

The tube 90 is made of an ablative, arc-extinguishing material. Although polytetrafluorolethylene (Teflon) is preferred, other materials such as Nylon, Delrin, horn fiber and the like may also be used. The piston 82 is also preferably made of Teflon, or any other material which (a) has ablative, arc-extinguishing properties and is electrically insulative, (b) sufficiently flexible to be maintained by pressure-generated forces in engagement with the walls of the pocket 76 and (c) the bore 92, and is able to withstand the heat of electrical arcing and of ignition of the power cartridge 72. The material of the piston 82 also preferably has a sufficiently poor elastic memory so that, once forced by pressure into engagement with the walls of the pocket 76 and the bore 92, it does not exhibit a significant tendency to disengage therefrom.

After the power cartridge 72 is ignited by an appropriate signal on the conductor 46 from the unit 44, its ignition products 98 apply the sealing and moving forces (arrows 88 and 94) to the piston 82 to move the contact 58 rightwardly. As the contacts 56 and 58 break engagement (FIG. 3*a*), these ignition products 98 are isolated from the contact 58 by the piston 82 and its flange 84. Arcing, as at 64 in FIGS. 3*b* and 3*c*, between the contacts 56 and 58 may ensue following the breaking of the normal electrical interconnection therebetween. If the arc 64 does form, the isolation of the contact 58 from the ignition products 98, the squeezing of the arc 64 between the piston 82 and the bore 92, the arcextinguishing action of the piston 82 and the tube 90, and the elongation of the arc 64 by continued movement of the contact 58 all contribute to either extinguishment of the arc 64 or the raising of the arc voltage. Either effect ensures commutation of current flowing in the first current path 68 to the second current path 70 (See FIG. 2).

In FIG. 3, the normal electrical interconnection between the contacts 55 and 58 is shown to be a simple telescopic engagement. To ensure good electrical continuity between the contacts 56 and 58, either or both may include flexible fingers (not shown) which are self-biased or biased by a garter spring (not shown) or the like. As described later with reference to the preferred embodiment of FIG. 6, the normal electrical interconnection between the contacts 56 and 58 may take other forms functionally similar to, but structurally different from, FIG. 3.

A housing 100 may enclose the contacts 56 and 58, the piston 82, the power cartridge 72 and the tube 90. The housing 100, which is preferably a filament-wound glass fiber-and-epoxy composite, may be mounted to the contact 58 and the tube 90 to maintain their relative positions. The housing 100 is within the housings 16 and 19 and is affixed thereto in any convenient manner, examples of which are depicted in the embodiments of FIGS. 4–6. This rigid structure and the engagement of both the piston 82 and the contact 58 aids in fixing the line of direction of movement of the contact 58 away from the contact 56.

In the preferred embodiment of FIG. 6, facilities which normally electrically interconnect the contacts 56 and 58 also prevent relative movement thereof until the power cartridge 72 is ignited. In the general embodiment of FIG. 3, such motion prevention may be effected by a member, such as a shear wire (not shown), connected between the contact 58 and a stationary element such as the housing 100 or the terminal 22. The shear wire may also serve the function of preventing movement of the contact 58 until sufficient pressure has built up in the chamber 60 to positively and rapidly drive the contacts 56 and 58 apart.

If necessary to prevent a pressure build up to the right of the contact 58 during its movement, appropriate vents (not shown) may be located in the housings 16,19 or 100. Movement of the contact 58 after its full separation from the contact 56 may be prevented by facilities like those described in the '650 application.

When the sensing and triggering unit 44 receives an output on the leads 50 from the current transformer 48 indicating that a fault current is flowing in the circuit which includes the terminals 20 and 22 and the contacts 56 and 58, an appropriate pulse or signal (i.e., appropriate as to magnitude, duration and timing with respect to the fault current) is transmitted on the output conductors 46 to the power cartridge 72. This pulse ignites the power cartridge 72, causing the rapid evolution and buildup of high pressure gas within the enclosed chamber 60. This pressure build-up causes the contacts 56 and 58 to part as the contact 58 is driven and moved rapidly away from the contact 56. When the contacts 56 and 58 move apart, the electrical interconnection therebetween is broken and the first current path 68 is opened. The first current path 68 includes, in series, the terminal 20, the left contact 56, the telescoped engagement between the contacts 56 and 58, the right contact 58, and the terminal 22. The motion-preventing member(s) previously referred to, (but not shown) which holds the contacts 56 and 58 in their normal positions may prevent motion of the contacts 56 and 58 until sufficient pressure builds up in the chamber 60 to ensure rapid movement apart of the contacts 56 and 58. The normally engaged portions of the contacts 56 and 58 and the shape of the chamber 56 and 58 may be configured so as to ensure the rapid parting of the contacts 56 and 58 without significant dissipation of the energy tending to move the contacts 56 and 58 apart.

Although FIG. 3 shows the contact 56 stationary and the contact 58 movable, both contacts may move. Such an embodiment is shown in FIG. 5, described below. The embodiments of FIGS. 4 and 6, which are similar to FIG. 3 as to the manner of contact movement, are called "side break" or "end break" switches. The embodiment of FIG. 5 (and those depicted in the '650 application) is called a "center break" switch.

The housing 100 not only electrically isolates the contacts 56 and 58 from other electrical structure which may be contained by the housings 16 and 19, as discussed below, but also may be relied on to prevent the ignition products (ionized or un-ionized hot gases) of the power cartridge 72 from reaching the remainder of the volume enclosed by these housings.

As described below with reference to FIGS. 4 and 6 and in the '650 application, surrounding the housing 100 may be the fuse 12 (not shown in FIG. 3) which may be either of the non-current-limiting or the current-limiting variety, although the latter is particularly contemplated by the present invention and represents a preferred embodiment. It is also preferred that the fuse 12 coaxially surrounds the housing 100 and all of the elements contained therewithin, and, when the fuse 12 is the preferred current-limiting fuse, it may coaxially and helically surround the housing 100.

The present invention, of course, contemplates second current paths 70 which do not surround (coaxially, helically or otherwise) the first current path 68, when such first path 68 includes the novel switch 14 hereof. Moreover, if the second current path 70 includes the fuse 12, which it need not, such fuse 12 may be current-limiting or non-current-limiting, the latter category including expulsion fuses. As used herein, "surround" means that the first current path 68 is at least partially encircled by the second current path 70. The second current path may be envisioned as lying partially or entirely on the surface of an imaginary volume, such as a cylinder, which totally encompases the first current path 68, with the points of connection between the paths 68 and 70 being angularly spaced from each other about the major axis of the volume; if the points of connection are not angularly spaced, then, the second current path 70 encircles the first current path 68 at least once.

The separation or movement apart of the contacts 56 and 58 has been previously described. The contact 56 moves along the fixed line of direction, as guided in part by the elements 74,80,82 and 90, following the detection of a fault current or overcurrent by the sensing and tripping unit 44 which ignites the power cartridge 72. As the contacts 56 and 58 separate, the above-described first current path 68 is opened thereby. This commutates or transfers the current flowing in the first current path 68 to the second current path 70, that is, in the case of FIGS. 1 and 2, to the fuse 12. Because of the wide separation or gap 66 achievable between the contacts 56 and 58 due to their ability to move far apart, the dielectric strength of the gap 66 therebetween reaches high values quite quickly and the commutated current is ultimately interrupted by operation of the fuse 12. Current commutation of the fuse 12 is ensured by suppressing, or extinguishing, the arc 64 tending to form, or forming, between the contacts 56 and 58; by ensuring that the voltage of such an arc 64 (should it form) is elevated; or by opening additional gaps in the first current path 68. Where the fuse 12 is a preferred current-limiting fuse 12, circuit interruption is effected in a current-limiting mode. To be completely accurate, if the sensing and triggering unit 44 ignites the power cartridge 72 so that current is commutated to the fuse 12 before a first fault-current loop reaches its peak, the device 10 acts in a "current-limiting" mode. If one or more fault current loops occur before current commutation to the fuse 12, the device 10 is more properly said to operate in an "energy limiting" mode.

To iterate, as used herein, the phrases "breaking the electrical interconnection" and "opening the first current path" mean:

(1) The conductive metallic connection between the contacts 56 and 58 is broken or rendered disintegral, whether the current through the switch 14 is interrupted at that exact time or whether the switch 14 is used with the second current path 70; and (2) The current is commutated to the second current path 70 following breaking of the conductive metallic connection, whether or not the arc 64 forms between the contacts 56 and 58.

The structure of the device 10 in FIGS. 1 and 2 which includes the switch 14 of FIG. 3 according to present invention should be contrasted with the earlier-described prior art devices. First, the coaxial arrangement of the various parts is quite convenient from a manufacturing standpoint, leading to economies in manufacture and labor and rendering the device 10 quite reasonable in cost. Second, since the contacts 56 and 58 are movable apart, successful operation of the device 10 does not depend on the contacts 56 and 58 merely being disintegrated and peeled back to create a gap therebetween; the contacts 56 and 58 may move apart just about any selected distance to effect a very large gap 66 therebetween. This large gap 66 ensures that current is commutated to the second current path 70. In addition, movement apart of the contacts 56 and 58 occurs as rapidly as the peeling back of various portions of bursting bridge structures of prior art devices. Third, the inductance of the device 10 has been decreased to an absolute minimum. Specifically, not only are the switch 14 and the fuse 12 contained within the same housings 16 and 19, thereby decreasing the length of the electrical connections therebetween, but also the current in being commutated from the first current path 68 to the second current path 70 is not required to make a great number of turns, and it flows in the second current path 70 in the same direction as it flows in the first current path 68. This decreases the inertia of the current flow which might otherwise cause it to resist changes in its direction and is manifested by the device 10 having a low inductance. Current flows in the second current path 70 in the same direction as it flows in the first current path 68, thereby experiencing minimal (or no) electromagnetic forces which tend to discourage its flow in the second current path 70.

As noted above, FIG. 3 is one generalized representation of the switch 14 of the present invention. Before describing the specific embodiments of FIGS. 4 and 5 and the preferred embodiment of FIG. 6, several contemplated modifications of FIG. 3, not shown therein, will be discussed.

First, the chamber 60 and the pocket 76 may have little or no unfilled volume before the switch 14 operates. Specifically, either or both may be completely filled by the piston 82 so as to leave no open space other than the compartment 96, which of course is a part of, or may constitute the entire, chamber 60.

Second, the piston 82 need not include the lip or flange 84. The piston 84 may be a cylindrical member or differently configured. It has been found that pistons 82 made of appropriate flexible materials and not having the lip 84 are acted on by pressure (88 and 94) to both move the contact 58 and flex or deform the piston to seal the periphery thereof against the walls of the contact 56 and of the tube 90 in an entirely satisfactory manner.

Third, the pocket 76, as such, need not necessarily be present. The piston 82 may directly abut the contact 56 closing one end of the compartment 96. Thus, the compartment 96 and the chamber 60 may be identical. In this event, the contacts 56 and 58 may be interconnected by a conductive member passing through the tube 90 which may also abut the contact 56 and be engaged by the piston 82 in all positions thereof. The conductive member may be sheared by movement apart of the contacts 56 and 58. In this arrangement, the piston 82 need not, but may, include the lip 84.

FIG. 4 depicts a specific embodiment of the device 10 using the switch 14. The same reference numerals found in FIGS. 1–3 have been used where possible, although the exact structure of elements similarly numbered may vary slightly among the Figures.

In FIG. 4 the cup-shaped member 74 which constitutes the left contact 56, also serves the function of supporting the tube 90 and the housing 100. Specifically, one end of the tube 90 may be attached as by cementing or the like to the cup-shaped member 74 as shown. Further, adjacent the chamber 60, the cup-shaped member 74 is annularly decreased in size as shown at 102, the housing 100 fitting into this annular decrease 102 and being attached thereto by cementing or the like. The cup-shaped member 74 also includes a more massive base portion 104 which is formed integrally with, or appropriately electrically connected, to an end ferrule 106 which closes the left end of the housings 16 and 19. The end ferrule 106 is made of a conductive material and may include a flanged portion 108 which is trapped between the housings 16 and 10 for sealing the interior thereof. The first terminal 20 is also electrically and mechanically attached to, or is formed integrally with the end ferrule 106 so that there is electrical continuity between the terminal 20 and the contact 56. Obviously, the cup-shaped member 74, including its base 104, the end ferrule 106, and the terminal 20, may take configurations other than those depicted.

The movable contact 58 has a slightly different configuration than that depicted in FIG. 3. Specifically, the movable contact 58 includes the conductive member 78 which has the enlargement 80 thereon and is attached to or formed integrally with a movable conductive rod 110. As was the case with FIG. 3, the enlargement 80 may be a solid member or may comprise a plurality of spring-biased fingers (not shown). In any event, in the normal position of the switch 14 depicted in FIG. 4, good electrical contact between the enlargement 80 and the end 77 of the pocket formed by the cup-shaped member 74, is appropriately ensured. The rod 110 passes through an aperture 112 formed in a stationary conductive body 114. The conductive body 114 is electrically and mechanically attached to, or formed integrally with, an end ferrule 116 which may be similar to the end ferrule 106, except that the end ferrule 116 also contains an aperture 118 for passage of the rod 110 therethrough. The conductive body 114 may contain an annular groove 120 in which is located an appropriate sliding contact structure generally depicted at 122. The sliding contact structure 122 ensures that regardless of the position of the rod 110, the rod and the movable contact 58 carried thereby are always in continuous electrical contact with conductive body 114. The second terminal 22 is electrically and mechanically attached to or otherwise formed integrally with the end ferrule 116. The terminal 22 may contain an aperture 124 for passage of the rod 110 therethrough.

When the power cartridge 72 is ignited and the contacts 56 and 58 separate, as described above with reference to FIG. 3, both the movable contact 58 and the rod 110 are moved rightwardly. The rod 110 may perform an indicating function upon such movement. Specifically, either the rod itself or some mechanism (not shown) operated thereby may provide a visual indication that the device 10 has operated due to opening of the switch 14. Of course the rod 110 may be eliminated or differently configured if such indicating function is not desired. In the event that the rod 110 is present and is intended to perform an indicating function, the remainder of the terminal 22, as well as the mounting facility 34, may require some modification or change to accomodate its movement. Such is believed to be within the skill of the art.

The fuse 12 may be located within an annular volume 126 defined between the housing 100 and the housing 19. If the fuse 12 is so located, the coaxial arrangement of the fuse 12 and the switch 14 described above is conveniently achieved.

The fuse 12 may include a fusible element 128 wound about an appropriate support 130 which may be attached to or formed integrally with the housing 100. The fusible element 128 may be a wire, or a ribbon, the latter being either helically flat-wound or edge-wound about the support 130. A more detailed description of such a fusible element 128 and support 130 may be found in commonly assigned U.S. Pat. No. 4,057,775 to Biller. The annular volume or compartment 126 defined between the housings 19 and 100 may be filled with a fulgurite-forming, particulate, arc-quenching medium such as silica or quartz sand 132 which surrounds the fusible element 128. Respective ends of the fusible element 128 are attached to respective conductive members such as the base portion 104 and the conductive body 114 in any convenient fashion (not shown). Accordingly, the fusible element 128 coaxially surrounds various elements of the first current path 68, including the contacts 56 and 58, the piston 82 and the conductive body 114, as well as the fixed line of direction of movement apart of contacts 56 and 58. Also, the fusible element 128 defines the second current path 70 in shunt with the contacts 56 and 58 and with the gap 66 opened therebetween following ignition of the power cartridge 72.

As noted earlier, FIG. 4 depicts a "side break" switch 14 in which only the contact 58 moves while the contact 56 remains stationary. FIG. 5 on the other hand, which shows another embodiment of the switch 14, is a so-called "center break" switch 14 utilizing the principles of the present invention. FIG. 5 uses reference numerals which are the same as those used in FIGS. 1 through 4 where possible, even though some slight structural differences between FIG. 5 and the earlier Figures may exist.

In FIG. 5 the conductive body 114 has the second terminal 22 formed integrally therewith. This terminal passes through an aperture 134 in the end ferrule 116 as shown. The end ferrule 116 is formed integrally with or is otherwise electrically, mechanically attached to conductive body 114 as shown. The conductive body 114 also includes a protruding portion 136 which enters and slidably electrically engages the walls of aperture 138 formed in the conductive member 78 which is somewhat larger and more massive than its counterparts in FIGS. 3 and 4. As the contact 58 and the conductive member 78 move rightwardly following ignition of the power cartridge 72, the conductive member 78 remains in continuous electrical sliding contact with the protruding portion 136. To this end, appropriate sliding contact structures (not shown) may be located at the interface of the protruding portion 136 and the walls of the aperture 138. The conductive body 114 may also include a flanged portion 140 which serves to support both the housing 100 and the tube 90 as shown.

The base portion 104 of the cup-shaped member 74 is also somewhat modified in FIG. 5 with respect to its configuration in FIG. 4. Specifically, the base portion 104 contains an aperture 142 slidable over and in continuous sliding electrical connection with a stationary conductive member 144. In the embodiment of FIG. 5, the contact 56 is also movable so that, as will be described shortly, such sliding electrical contact between the aperture 142 and the stationary conductive member 144 is necessary. The contact 56 is otherwise similar to the same-numbered contact shown in FIGS. 3 and 4.

The stationary conductive member 144 is connected to or formed integrally with the first terminal 20 as shown. Intermediate the conductive member 144 and the terminal 20 may be a flange 146 which serves the function of both supporting the housing 100 and closing the end thereof. The terminal 20 may pass through an aperture 148 formed in the end ferrule 106. Moreover, the output conductors 46 from the unit 44 may run through the terminal 20 and the conductive member 144 for appropriate connection to the power cartridge 72 as shown.

The piston 82 may be connected to the contact 58 by connecting facilities generally indicated at 150 which may take the form of a stud or rivet-like member.

In FIG. 5 the enlargement 80 of the contact 58 may take the form shown, which is that of a plurality of finger-like members(only two are shown) which are biased outwardly into engagement with the walls of the pocket 76 by one or more appropriate spring members 152. The enlargement 80 may also contain, somewhat remote from its point of contact with the pocket 76, one or more appropriate indentations 154. The indentations 154 are entered by protrusions 156 formed on spring members 158 supported by the tube 90 for holding the contact 58 in a rightward position following ignition of the power cartridge 72 and separation of the contacts 56 and 58. For details on additional facilities for maintaining either of the contacts 56 or 58 in their separated positions following the ignition of the power cartridge 72, reference should be made to the '650 application.

FIG. 6 depicts a specific preferred embodiment of the present invention. To the extent possible, reference numerals used in earlier Figures have also been used in FIG. 6 even though the specific element referred to may be somewhat structurally different than in other Figures.

Figure 7A:
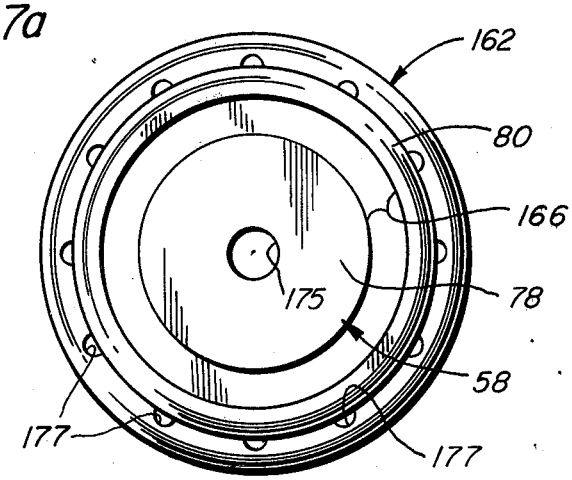
Figure 7B:
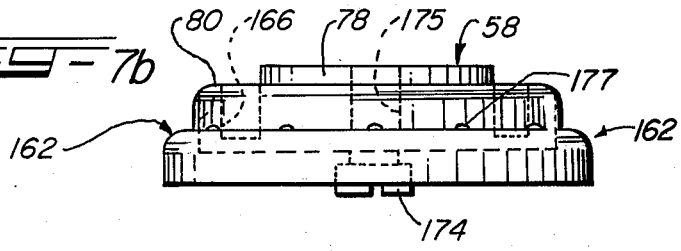
Figure 7C:
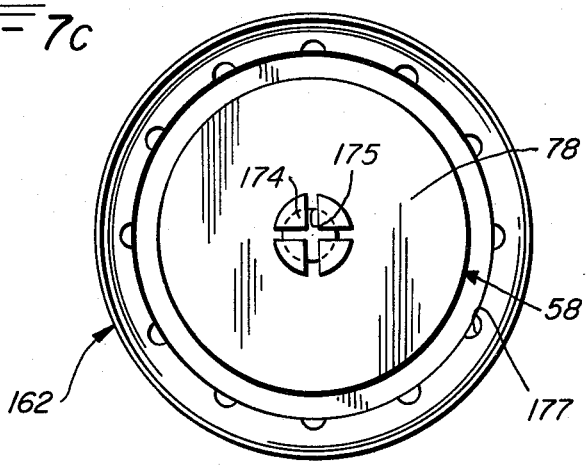

The device in FIG. 6 operates in a manner similar to that described above with respect to FIGS. 1 through 5. The device 10 of FIG. 6 includes the stationary contact 56 which takes the form of the cup-shaped member 74 which defines part of the pocket 76 and the end 77 of such pocket. The cup-shaped member 74 in this particular embodiment is formed integrally with a portion of the end ferrule 106 as shown. The remainder of the pocket 76 is defined by the base portion 104, which in this embodiment is shown to be formed separately from the cup-shaped member 74, but is electrically and mechanically attached thereto. Base portion 104 also defines in this embodiment the compartment 96 which houses the power cartridge 72. Adjacent to the end 77 of the pocket 76, the cup-shaped member 74 has formed therein an annular groove 160. Fitting into and attached to the groove 160 is the forward edge of an annular or ring-like silver diaphragm 162 which is shown in greater detail in FIG. 7. Jointly attached to the forward edge of the diaphragm 162 and to the back surface of the annular groove 160 is an annular cutting member 164. The diaphragm 162 is stepped slightly forwardly of the cutting member 164 and has its rearward section attached to the conductive member 78 which takes the form of a copper or bronze member which is brazed or soldered to the diaphragm 162.

A circular groove 166 is formed in the conductive member 78 immediately adjacent the point of attachment between the diaphragm 162 and such conductive member 78. Connected to the conductive member 78 and inserted into the groove 166 is a conductive metallic tubular member 168. The tubular member 168 and the conductive member 78 together constitute the movable contact 58.

The metallic tube 168 extends rightwardly to a point 170 where its diameter slightly decreases. The decreased diameter portion 170 of the tube 168 is normally in sliding electrical contact with the forward end 172 of the conductive body 114, which takes the form of an elongated finger-like conductive element. The piston 82 is attached to the conductive member 78 by means of a stud-like portion 174 formed on the left side of the member 78. An appropriately shaped end of the rod 110, which is utilized in this embodiment, is forced into an aperture 175 centrally located in the stud-like portion 174 to spread the stud-like portion 174 apart, thus joining the piston 82 to the conductive member 78. Obviously, other modes of attachment between the member 78 and the piston 82 can be selected. As already noted, the rod 110 is depicted in this embodiment and may perform a function similar to that performed by the rod 110 of FIG. 4.

As shown, the base portion 104 forms a central portion of the end ferrule 106 and is formed integrally with the left terminal 20. The output conductors 46 connected to the power cartridge 72 pass through a bore formed in such terminal 20.

The right terminal 22 contains a diaphragm 176 closing the aperture 124 therethrough. This diaphragm 176 prevents the entry of moisture or other contaminants into the interior of the device 10. When the switch 14 operates and the rod 110 moves rightwardly, such rod pierces or punctures and passes through the diaphragm 176 to perform its indicating function as previously described.

The operation of the device depicted in FIG. 6 is similar to that described above. When the power cartridge 72 is ignited, the enclosed chamber 60 is pressurized, applying appropriate forces to the piston 82 to drive both the piston and the contact 58 rightwardly and to seal the flange 84 of the piston against first the walls of the pocket 76 and later against the walls of the tube 90. Since one end of the diaphragm 162 is attached to the cup-shaped member 74, and the other end is attached to the enlargement 80 of the conductive member 78, the contacts 56 and 58 are prevented from relatively moving until the chamber 60 is pressurized. Initial movement of the contact 58 away from the contact 56 causes the cutting member 164 to sever the diaphragm 162. As more clearly shown in FIG. 7, to aid in the severing and ultimate breaking or tearing of the diaphragm 162, the line of engagement between the cutting member 164 and the diaphragm 162 may contain a plurality of performations or holes 177 which aid in the diaphragm 162 becoming disintegral as the contact 58 moves. As the pressure buildup due to ignition of the power cartridge 72 becomes sufficient to move the contact 58, the diaphragm 162 tears, rips, or is cut. At this point the contact 58 and the attached metal tube 168 move rightwardly. The rod 110 also moves rightwardly. After an initial amount of rightward movement, direct electrical contact between the metallic tube 168 and the forward end 172 of the conductive body 114 is broken. This creates a second physical gap in the first current path 68 in addition to that physical gap open between the contacts 56 and 58. Such second gap tends to raise the voltage drop of the first current path 68 to ensure commutation of the current therefrom to the second current path 70.

It should be noted that unlike the embodiments of FIGS. 2 through 5, the normal electrical interconnection between the contacts 56 and 58 in FIG. 6 does not involve direct physical contact between such contacts 56 and 58. Rather, as can be seen from the Figure, the normal electrical interconnection between the contacts 56 and 58 is provided by the diaphragm 162. When the diaphragm 162 is cut or severed due to movement of the contact 58, this normal electrical interconnection between such contacts 56 and 58 is broken.

The fuse 12 of the embodiment depicted in FIG. 6 is a current-limiting fuse in which the fusible element 128 is flat-wound rather than edge-wound, in contrast to FIG. 4. The support 130 also has a slightly different configuration from that depicted in FIG. 4, but the function of both the support 130 and the fusible element 128 is similar to or the same as that described in the description of FIG. 4 above.

Various water-tight or contaminant-tight seals between various portions of the device 10 are all indicated by the reference numeral 178 and may take any convenient form as is well known.

During shipment of the device, prior to its usage in the mounting facilities 24 and 34, provisions may be made to prevent ignition of the power cartridge 72 which could conceivably be ignited by low-current, static electric discharges inherent in normal handling and shipping. To this end, the terminal 20 is elongated and at its outer end carries an electrically insulative finger 180. Contacts 182 are carried by the finger 180 and are electrically continuous with respective ones of the output conductors 46 connected to the power cartridge 72. A molded plastic cup 182, having an aperture 184 therein, is placed over the terminal 20 until the device 10 is to be used. The aperture 184 is lined with a conductive coating or foil 186. When the cap 182 is in place, the coating or foil 186 electrically shorts together the contacts 182 thus preventing a difference in potential from being applied to the contacts 182 and accordingly preventing ignition of the power cartridge 72. When it is desired to use the device 10, the cap 182 is removed and the terminal 20 is placed into an appropriate mounting facility 24 or 34. Simultaneously with such placement, the contacts 182 are engaged with mating contacts connected to conductors which run to the sensing and triggering unit 44.

Various changes may be made in the above described embodiments of the present invention without departing from the spirit and scope thereof. Such changes as are within the scope of the claims that follow are intended to be covered thereby. For example, whether the electrically interconnected contacts 56 and 58 are normally physically engaged (as shown in FIGS. 2 through 5) or not (as shown in FIG. 6), either one or both may carry a piston coacting with a pocket in the other contact or elsewhere to define the chamber 60. The ignition of the power cartridge 72 moves the piston 82 to move the contact 56 or 58 carrying it. Both contacts 56 and 58 need not be movable; one may be stationary. Where one of the contacts 56 or 58 includes a plurality of fingers, such fingers may be so constructed or spring-loaded that a fault current in the first current path 68 flexes the fingers inwardly away from the walls of the pocket 76 or other walls being contacted to permit free relative movement of the contacts 56 and 58. Also, the diaphragm 162 may take a variety of configurations, cross-sections, shapes, and can be made of a variety of materials. What is important concerning the diaphragm 162 is that it be adequate to carry the normal current flowing in the first current path 68 and be easily severable or cutable upon initial movement apart of the contacts 56 and 58. It should be apparent that the high conductivity first current path 68, including the contacts 56 and 58, eliminates the necessity of the second current path 70 carrying continuous high-level currents. Whether the fusible element 128 is found in a current-limiting or non-current-limiting fuse 12, the continuous current rating of the device 10 is both high and almost solely dependent on the first current path 68.

What is claimed is:

1. A high-voltage electrical switch for opening a current path in which the switch is included, comprising:

first and second normally electrically interconnected contact means for normally carrying current in the current path, the contact means being relatively movable apart along a fixed line of direction, movement of the contact means apart breaking the electrical interconnection therebetween to open the first current path;

piston means on the second contact means (a) for defining an enclosed chamber with the first contact means when the contact means are interconnected (b) for continuously isolating the second contact means from the chamber, and (c) for constricting an arc formed between the contact means; and means for pressurizing the chamber to rapidly drive the contact means apart.

2. A high-voltage electrical switch for opening a current path in which the switch is included, comprising:

first and second normally electrically interconnected contact means for normally carrying current in the current path, the contact means being relatively movable apart along a fixed line of direction, movement of the contact means apart breaking the electrical interconnection therebetween to open the first current path, the first contact means having a pocket;

a piston on the second contact means for defining an enclosed chamber with the pocket when the contact means are interconnected, the piston having a composition and a configuration relates to the pocket and to forces applied thereto by pressurization of the chamber so that the piston intimately engages the walls of the pocket before and as the contact means move apart, the intimate engagement isolating the second contact means from the chamber;

a tubular member through a bore of which the second contact means and the piston move as the contact means move aparrt, the bore being configured so as to be intimately engaged by the piston as the piston moves therethrough to isolate the second contact means from the chamber; and means for pressurizing the chamber to rapidly drive the contact means apart.

3. The switch of claim 2, wherein:

the tube and the piston are made of ablative, arc-extinguishing materials.

4. The switch of claim 3, wherein:

an arc formed between the parting contact means must pass, and is constricted by, the intimately engaged interface between the piston and the bore, the arc being extinguished by the constriction thereof, by the action of the arc-extinguishing materials, and by the elongation of the arc effected by the parting of the contact means.

5. A high-voltage electrical switch for opening a current path in which the switch is included, comprising:

first and second contact means for normally carrying current in the current path, the contact means being relatively movable apart along a fixed line of direction, the first contact means having a pocket;

metallic conductive means for normally, metallically, electrically interconnecting the contact means, movement of the contact means apart breaking the normal metallic interconnection therebetween;

a piston on the second contact means for defining an enclosed chamber with the pocket when the contact means are metallically interconnected, the piston having a composition and a configuration related to the pocket and to forces applied thereto by pressurization of the chamber so that the piston intimately engages the walls of the pocket before and as the contact means move apart, the intimate engagement isolating the second contact means from the chamber;

a tubular member through a bore of which the second contact means and the piston moves as the contact means move apart, the bore being configured so as to be intimately engaged by the piston as the piston moves therethrough to isolate the second contact means from the chamber; and means for pressurizing the chamber to rapidly drive the contact means apart.

6. The switch of claim 5, wherein:

the tube and the piston are made of ablative, arc-extinguishing materials.

7. The switch of claim 6, wherein:

an arc formed between the parting contact means must pass, and is constricted by, the intimately engaged interface between the piston and the bore, the arc being extinguished by the constriction thereof, by the action of the arc-extinguishing materials, and by the elongation of the arc effected by the parting of the contact means.

8. The switch of claim 7, wherein:

the pressurizing means comprises a selectively ignitable power cartridge, ignition of which generates gaseous ignition products in the chamber, the intimate engagement of the piston with the pocket walls and the bore inhibiting the ignition products from coming into physical contact with the second contact means.

9. The switch of claim 8, wherein:

the power cartridge is in the chamber.

10. The switch of claim 9, wherein:

the metallic conductive means comprises a metal member normally attached to and connected between the contact means, movement apart of which severs or tears the metal member to break the normal metallic interconnection between the contact means.

11. The switch of claim 10, wherein:

the metal member is a continuous, closed member surrounding portions of the pocket and the contact means.

12. The switch of claim 11, wherein:

the metallic conductive means further comprises means for enhancing the severing or tearing of the metal member as the contact means move apart.

13. The switch of claim 12, wherein:

the enhancing means comprises a weakened area of the metal member.

14. The switch of claim 13 in which the contact means are slightly separated prior to their movement apart, wherein:

the weakened area comprises a perforation through the metal member, the perforation being located between the separated contact means.

15. The switch of claim 14, wherein:

the contact means and the metal member are all generally cylindrically shaped, there being a plurality of perforations through the metal member.

16. The switch of claim 10, which further comprises:

means for cutting or severing the metal member as a portion thereof moves incident to movement apart of the contact means.

17. The switch of claim 16, wherein:

the cutting or severing means comprises a cutting edge.

18. The switch of claim 17, wherein:

the cutting edge is fixed to the first contact means.

19. The switch of claim 18, wherein:

the metal member and the cutting edge are continuous, closed members surrounding portions of the pocket and the contact means.

20. The switch of claim 19, wherein:

the metallic conductive means further comprises means for enhancing the severing or tearing of the metal member by the cutting edge as the contact means move apart.

21. The switch of claim 20, wherein:

the enhancing means comprises a weakened area of the metal member.

22. The switch of claim 21 in which the contact means are slightly separated prior to their movement apart, wherein:

the weakened area comprises a bend in the metal member located between the separated contact means, and a perforation through the metal member, the perforation being located at or near the bend, the cutting edge being in contact with the bend prior to movement apart of the contact means.

23. The switch of claim 22, wherein:

the contact means, the metal member, and the cutting edge are all generally cylindrically shaped, there being a plurality of perforations through the metal member.

24. The switch of claim 9, wherein:

the metallic conductive means comprises a region of physical engagement between the contact means.

25. The switch of claim 24, wherein the contact means are generally cylindrical and are telescoped together prior to movement apart thereof.

26. The switch of claim 25, wherein:

the second contact is normally telescoped within the first contact.

27. A high-voltage device which includes the switch of claim 2, 3, 5, 6, 9, or 10, and which further comprises:

a shunt current path in electrical parallel with the contact means prior to their movement apart, movement apart of the contact means commutating current to the shunt current path.

28. A high-voltage fuse which includes the high-voltage device of claim 27, wherein:

the shunt current path includes a fusible element.

29. A high-voltage current-limiting fuse which includes the high-voltage fuse of claim 27, and which further comprises:

a quantity of a particulate arc-quenching medium surrounding the fusible element, the fusible element and the arc-quenching medium surrounding the switch and the fixed line of direction.

30. The switch of claim 5, which further comprises:

means for preventing movement of the contact means apart prior to pressurization of the chamber by the pressurizing means.

31. The switch of claim 30, wherein:

the movement preventing means includes the metallic conductive means.

32. The switch of claim 2 or 5, wherein:

the piston is flexible and has a sufficiently poor elastic memory so that forces caused by the pressurization of the chamber flex the piston to force it against the walls of the pocket as the contact means move apart to produce a zero clearance between the piston and the pocket walls, the poor elastic memory of the piston retarding movement thereof away from the pocket walls.

33. The switch of claim 2 or 5, wherein:

the pocket and the bore form a continuous passage, the enclosed chamber expanding as the contact means move apart to include first the pocket and then the bore, and the piston is flexible and has a sufficiently poor elastic memory so that forces caused by the initial pressurization of the chamber flex the piston to force it first against the walls of the pocket and then against the bore as the contact means move apart to produce a zero clearance condition between the piston and the pocket walls and the bore, the poor elastic memory of the piston retarding movement thereof away from the pocket walls and the bore as the inertial movement of the second contact means expands the chamber and the pressure therewithin decreases.

34. The switch of claim 33, wherein:

the piston and the tubular member are made of ablative, arc-extinguishing materials.

35. A high-voltage device which includes the switch of claim 34, and which further comprises:

a shunt current path in electrical parallel with the contact means prior to their movement apart, movement apart of the contact means commutating current to the shunt current path.

36. A high-voltage fuse which includes the high-voltage device of claim 35, wherein:

the shunt current path includes a fusible element.

37. A high-voltage current-limiting fuse which includes the high-voltage fuse of claim 36, and which further comprises:

a quantity of a particulate arc-quenching medium surrounding the fusible element, the fusible element and the arc-quenching medium surrounding the switch and the fixed line of direction.

38. The switch of claim 5, wherein:

the metallic conductive means comprises a metal member normally attached to and connected between the contact means, movement apart of which severs or tears the metal member to break the normal metallic interconnection between the contact means.

39. The switch of claim 38, wherein:

the metal member is a continuous, closed member surrounding portions of the pocket and the contact means.

40. The switch of claim 39, wherein:

the metallic conductive means further comprises means for enhancing the severing or tearing of the metal member as the contact means move apart.

41. The switch of claim 40, wherein:

the enhancing means comprises a weakened area of the metal member.

42. The switch of claim 41 in which the contact means are slightly separated prior to their movement apart, wherein:

the weakened area comprises a perforation through the metal member, the perforation being located between the separated contact means.

43. The switch of claim 42, wherein:

the contact means and the metal member are all generally cylindrically shaped, there being a plurality of perforations through the metal member.

44. The switch of claim 43, which further comprises:

means for cutting or severing the metal member as a portion thereof moves incident to movement apart of the contact means.

45. The switch of claim 44, wherein:

the cutting or severing means comprises a cutting edge.

46. The switch of claim 45, wherein:

the cutting edge is fixed to the first contact means.

47. The switch of claim 46, wherein:

the metal member and the cutting edge are continuous, closed members surrounding portions of the pocket and the contact means.

48. The switch of claim 47, wherein:

the metallic conductive means further comprises means for enhancing the severing or tearing of the metal member by the cutting edge as the contact means move apart.

49. The switch of claim 48, wherein:

the enhancing means comprises a weakened area of the metal member.

50. The switch of claim 49 in which the contact means are slightly separated prior to their movement apart, wherein:

the weakened area comprises a bend in the metal member located between the separated contact means and a perforation through the metal member, the perforation being located at or near the bend, the cutting edge being in contact with the bend prior to movement apart of the contact means.

51. The switch of claim 50, wherein:

the contact means, the metal member, and the cutting edge are all generally cylindrically shaped, there being a plurality of perforations through the metal member.

52. The switch of claim 2 or 5, wherein:

the first contact means is stationary.

53. The switch of claim 4,7,15,23,26,43 or 51, wherein:

the first contact means is stationary.

54. A high-voltage device which includes the switch of claim 53, and which further comprises:

a shunt current path in electrical parallel with the contact means prior to their movement apart, movement apart of the contact means commutating current to the shunt current path.

55. A high-voltage fuse which includes the high-voltage device of claim 54, wherein:

a shunt current path includes a fusible element.

56. A high-voltage current-limiting fuse which includes the high-voltage fuse of claim 55, and which further comprises:

a quantity of a particulate arc-quenching medium surrounding the fusible element, the fusible element and the arc-quenching medium surrounding the switch and the fixed line of direction.

57. A high-voltage electrical switch for opening a current path in which the switch is included, comprising:

first and second normally interconnected contact means for normally carrying current in the current path, the contact means being relatively movable apart along a fixed line of direction, movement of contact means apart breaking the electrical interconnection therebetween to open the current path;

piston means on the second contact means for defining an enclosed chamber with the first contact means when the contact means are interconnected;

means for pressurizing the chamber to rapidly drive the contact means apart; and a tubular member through a bore of which the second contact means and the piston means move as the contact means move apart, the bore and the piston means being configured so as to be in intimate engagement as the piston means moves therethrough to isolate the second contact means from the chamber.

58. The switch of claim 57, wherein the piston means is a body of flexible material, forces caused by pressurization of the chamber flexing or deforming the piston means to force it against the walls of the bore.

59. The switch of claim 57 or 58, wherein the piston means is made of an ablative, arc-extinguishing material.

60. The switch of claim 58, wherein the piston means and the tubular member are made of ablative, arc-extinguishing materials.

61. The switch of claim 57, wherein the first contact means has a pocket, the piston means and the pocket defining the chamber when the contact means are interconnected, the pocket and the piston means being configured so as to be in intimate engagement as the contact means move apart.

62. The switch of claim 61, wherein the piston means is a body of flexible material, forces caused by pressurization of the chamber flexing or deforming the piston means to force it against the walls of the pocket and of the bore.

* * * * *

UNITED STATES PATENT AND TRADEMARK OFFICE

CERTIFICATE OF CORRECTION

PATENT NO. : 4,342,978

DATED : August 3, 1982

INVENTOR(S) : Otto Meister

It is certified that error appears in the above—identified patent and that said Letters Patent is hereby corrected as shown below:

In Claim 2, line 15 (Column 24, line 58), delete "relates," and insert -- related --;

In Claim 27, line 2 (Column 27, line 8), delete "2, 3, 5, 6, 9 or 10," and insert -- 2, 3, 4, 5, 6 or 7 --;

In Claim 29, line 2 (Column 27, line 17), delete "27," and insert -- 28 --; and

In Claim 44, line 1 (Column 28, line 36), delete "43," and insert -- 38 --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*